United States Patent [19]

Gombas

[11] 4,205,844

[45] Jun. 3, 1980

[54] GAME RACKET

[76] Inventor: Laszlo A. Gombas, Rte. 7, Box 555Q, Evergreen, Colo. 80439

[21] Appl. No.: 874,256

[22] Filed: Feb. 1, 1978

[51] Int. Cl.[2] ..... A63B 49/12; A63B 49/08

[52] U.S. Cl. ..... 273/73 H; 273/73 G; 273/73 J

[58] Field of Search ..... 273/73 R, 73 C, 73 D, 273/73 E, 73 G, 73 H, 73 J, 75, 76

[56] References Cited

U.S. PATENT DOCUMENTS

| | | | |
|---|---|---|---|
| 1,588,140 | 6/1926 | Penney | 273/73 H |
| 1,750,644 | 3/1930 | Norton | 273/73 J |
| 3,540,728 | 11/1970 | Palmer | 273/73 J |
| 3,547,440 | 12/1970 | Deer | 273/73 J X |
| 3,582,073 | 6/1971 | Melnick | 273/73 J X |
| 3,625,512 | 12/1971 | Latham et al. | 273/73 H X |
| 3,674,267 | 7/1972 | Hollis | 273/73 J X |
| 3,702,701 | 11/1972 | Vaughn et al. | 273/73 H |
| 3,724,850 | 4/1973 | Stevens | 273/73 G X |
| 3,908,995 | 9/1975 | Portz | 273/73 G |
| 3,930,648 | 1/1976 | Brown | 273/73 D |
| 4,046,377 | 9/1977 | Khazzam | 273/73 G |

FOREIGN PATENT DOCUMENTS

| | | | |
|---|---|---|---|
| 1812905 | 10/1969 | Fed. Rep. of Germany | 273/73 J |
| 2010450 | 9/1971 | Fed. Rep. of Germany | 273/73 G |
| 2224316 | 11/1973 | Fed. Rep. of Germany | 273/73 H |
| 2321911 | 2/1977 | France | 273/73 H |
| 229174 | 2/1925 | United Kingdom | 273/73 J |

*Primary Examiner*—Richard J. Apley
*Attorney, Agent, or Firm*—Kyle W. Rost

[57] ABSTRACT

A game racket has a metal frame, elastomeric yoke, and preformed handle. The frame cross-section employs opposite tubular elements joined by a central web, with the tubular walls facing oppositely from the web being formed in an arch having a common radius at the midpoint of the web. The yoke employs torque box construction and has an integral metal arch anchoring the yoke to the racket frame, and the yoke has laterally extending lips that engage the surfaces of the frame to damp vibration from the racket face. The handle employs a sleeve overlapping divergent portions of the metal frame and a central plug that fits between the divergent frame portions to hold them in spaced relationship, or alternatively the handle employs front and rear caps having an intermediate foamed plastic or elastomer body.

17 Claims, 14 Drawing Figures

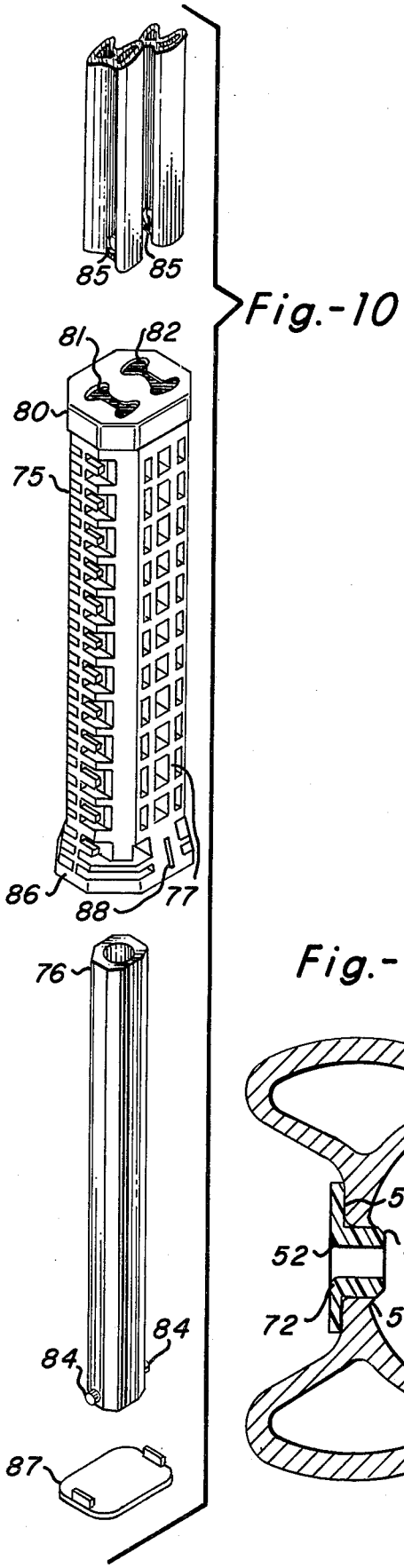
Fig.-10
Fig.-11
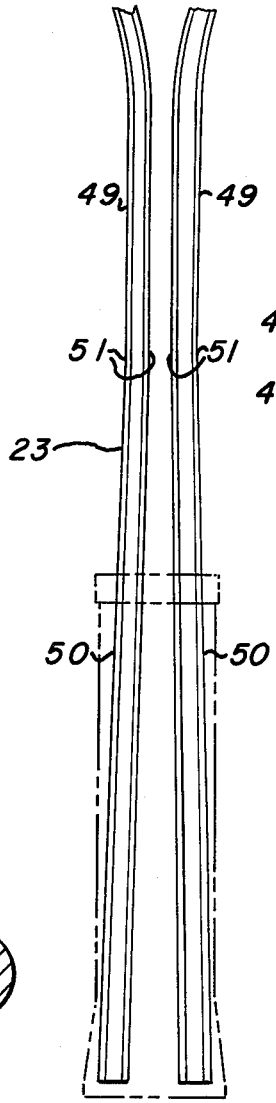
Fig.-12
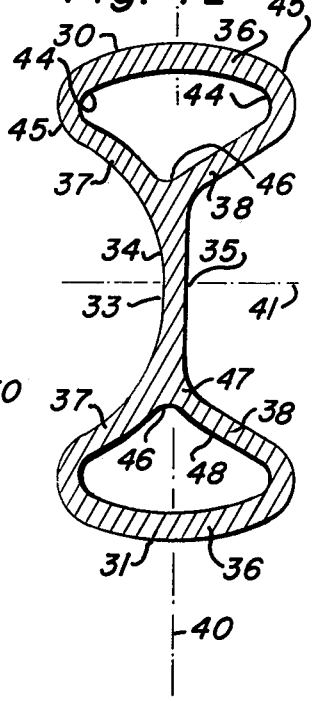
Fig.-13
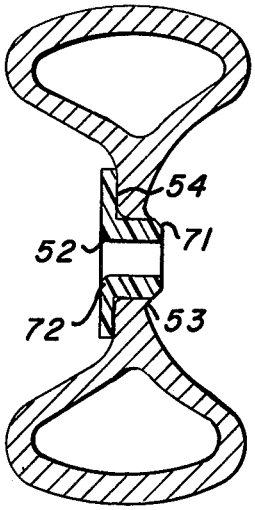
Fig.-14
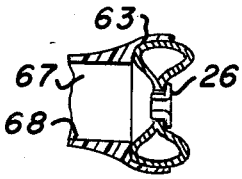

GAME RACKET

BACKGROUND OF THE INVENTION

1. Field of the Invention

The invention relates primarily to amusement devices and games, especially to racket games such as tennis and racket ball. A racket having a metal frame, bi-material throat, and elastomer handle is disclosed.

2. Description of the Prior Art

Metal game racket, especially tennis rackets, have been known for many years. These rackets offer known advantages over common wood tennis rackets, primarily in longer life due to better resistance against breaking, warping, and general physical abuse as might be suffered during the course of a game.

Tennis rackets with metal frames have been designed to meet a broad variety of performance characteristics, some of which are best judged subjectively during play. Among these is the size of the "sweet spot", which is the portion of the strung racket face that delivers a true return against the tennis ball. U.S. Pat. No. 3,999,756 to Head teaches the enlargement of the sweet spot by enlarging the area of the racket. Some players find this solution objectionable, however, because other playing characteristics of such a racket are apparently altered.

Metal framed rackets have also been designed to conform to various objective criteria, such as specified longitudinal flexibility, torsional flexibility, and strength factors of the frame extrusion. U.S. Pat. No. 3,625,512 to Latham et al. discloses a frame extrusion that is reasonably stiff for a less flexible racket than many in the prior art, and the extrusion is also shaped to protect the strings against damage from tension or abrasion. U.S. Pat. No. 3,702,701 to Vaughn discloses a frame extrusion that is said to offer a uniquely high strength factor, thereby allowing the use of grommet strips to extend string life without producing an overly heavy racket. Typical strung racket weights are acceptable when between about eleven ounces for very light rackets and fourteen ounces for heavy rackets.

Another important characteristic of a racket is its ability to damp the vibration created when the racket strikes a ball. This vibration is propagated at the head of the racket and generates through the handle to the player's hand and arm. A painful condition known as tennis elbow can result from continued absorbtion of these vibrations by the player's arm. Metal framed rackets are thought to be more guilty of causing tennis elbow than are wood framed rackets.

The goals of improving playability, protecting strings, improving the strength of the frame extrusion, and damping vibrations are ongoing in racket development and are the subject of the present invention.

SUMMARY OF THE INVENTION

A racket for games such as tennis and racket ball is constructed with a metal frame having an exceptionally strong strength to weight ratio. The frame is characterized by a cross-section having a pair of hollow tubular elements joined at opposite ends of a central web, wherein the sides of the tubular elements opposite from the web are in the shape of an arc having a radius at the midpoint of the web, and the cross-sectional surface area of the web is approximately fifteen percent of the total cross-sectional surface area of the metal frame strip. The metal frame forms the racket face with an open throat and then forms a handle section of the racket.

The throat is closed by a yoke having a first bridge concave to the racket face, and a second bridge convex to the racket face and spaced closer to the handle than the first bridge. The bridges are joined by spaced walls in the plane of the racket to form a torque box structure, and lips on the lateral edges of the walls cooperate to grip the metal frame and damp vibration from the face of the racket as it attempts to travel through the frame toward the handle. The yoke also engages elongated eyelet tubes from a grommet strip to guide the racket strings from the frame to stringing apertures in the first bridge. A special grommet strip includes shielding means for protecting the metal frame from abrasion and is especially suited for use in a racket ball racket.

The handle portion of the frame terminates in opposite free ends of the metal strip and is engaged by a handle grip, which may be a sleeve that overlaps the free ends of the frame and a plug that fits between the free ends to hold them in spaced relationship snugly against the interior of the sleeve. The handle portion of the frame is formed from two spaced lengths of the metal frame strip, and these lengths are divergent as they approach the free ends, allowing the plug between these divergent portions to lock the frame inside the sleeve. An alternative form of the handle employs forward and rearward caps with integral means for holding the frame portions in the desired spaced relationship, and either a foamed plastic alone or foamed plastic plus the aforementioned plug may be applied to cooperate with caps in completing the handle.

The main object of the invention is to create a tennis racket having exceptionally high vibration damping characteristics, while at the same time having an extremely rigid frame. A rigid frame without proper vibration damping characteristics is highly objectionable and can produce inflamation in the player's arm. Accordingly, the disclosed metal frame employs vibration damping lips on the yoke, a polyurethane grommet strip, and a polyurethane sleeve in the handle grip.

Another object is to create a yoke constructed of synthetic materials, but that is able to retain its form and position with respect to the metal frame even when the racket is strung at high string tensions. For this purpose, a metal arch is integrally joined to the yoke to act as a pivot and anchor to hold the yoke in place and resist deformation. The described yoke employs the metal arch in the bridge farthest from the racket face, avoiding contact between the strings and metal.

A further object is to create a yoke that is exceptionally rigid in its torsional characteristics. The described yoke employs first and second oppositely arched, spaced bridges joined by spaced walls in the racket plane to form a torque box structure. This yoke has torsional characteristics to compliment the rigidity of the metal frame, while maintaining damping characteristics that are desirable in play.

Another important object is to create a handle grip that can be preformed and quickly attached to a metal frame with permanency. One of the described grip structures employs a sleeve and central plug structure that cooperated with divergence of the frame portions toward the butt of the handle to lock the grip in place. Another form of the handle grip employs preformed front and rear caps that hold the metal frame in the desired position and allow the use of either a plug or foamed synthetic material as a filler between the caps, creating a light weight handle.

These and other objects of the invention are achieved as more fully described below.

BRIEF DESCRIPTION OF THE DRAWINGS

FIG. 10 is an exploded perspective view of the handle grip of FIG. 7.

FIG. 11 is a front elevational view of the racket frame, showing the bending pattern thereof, with the yoke and handle grip shown in phantom.

FIG. 12 is an enlarged cross-sectional view of the metal racket frame.

FIG. 13 is a cross-sectional view of the grommet strip and metal frame taken through the plane of line 13—13 of FIG. 2, showing the configuration through one of the stringing holes.

FIG. 14 is a cross-sectional view taken along the plane of line 14—14 of FIG. 1, showing the relationship of the yoke lips to the frame.

DESCRIPTION OF THE PREFERRED EMBODIMENT

Figure 1:
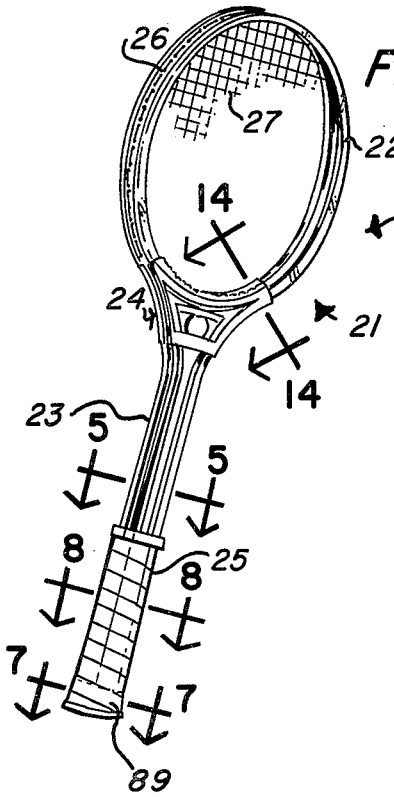
FIG. 1 is a perspective view of the game racket.

The tennis racket 20 as best shown in FIG. 1 is of the type having a metal frame 21, for example of extruded aluminum, partially forming the face portion 22 of the racket and extending in spaced relationship to define a handle portion 23. The face of the racket is completed, in conjunction with the part formed by the frame portion 22, by yoke 24 that engages the frame 21 and is fastened thereto. The free ends of the frame extrusion 21 are engaged in a handle grip 25. A grommet strip 26 may be employed on the outer surface of the face portion of the extrusion to provide a cushioned base for the strings 27.

The frame 21 is formed in a highly efficient cross-section best shown in FIG. 12. This extrusion has an extremely high section modulus over area ratio, and is able to provide longitudinal rigidity in the racket comparable to some graphite rackets.

FIG. 12 shows the extrusion to have a pair of mirror-image tubular elements 30 and 31, which will be referred to as the front and rear of the plane of the racket. An intermediate web 33 joins elements 30, 31 and together with them defines channel 34 facing inwardly with respect to the racket outline, and channel 35 facing outwardly and oppositely from channel 34. The cross-section of the extrusion may have a surface area between 0.075 and 0.120 sq. in. with between 10% and 20% of the area being in the web, preferably 15%. The length of the web may be between 37% and 41% of the total distance through the web and elements 30, 31, with a length of 39% being preferred.

Element 30 has a front facing wall 36 joined to web 33 by inward wall 37 and outer wall 38, the latter two walls forming an approximate Y-shape with web 33. Wall 36 is a radius from the midpoint of web 33, and wall 37 cooperates with the inner face of web 33 to form inner channel 34 in an arch shape having a uniform radius. The outer face of web 33 is a flat plane and wall 38 angles outwardly and forwardly from the plane at an angle of 60 degrees. Both the forward and rearward halves of web 33 are mirror images of each other, and accordingly the above description of the general contour of the web and front facing tube 30 also has made clear the contour of the rear facing half of the web and the element 31. Accordingly, similar rearward facing parts are numbered 36–38 in corresponding fashion.

Forming the front and rear tubular walls 36 with a radius from the midpoint of the web provides great efficiency in the strength-weight ratio of the cross section. Further, the arch of the inner channel 34 provides the required strength for the extrusion to withstand the high local shear forces created by the tension of the racket strings 27. At the same time, the mass of the cross-section has been held to a minimum at the center, which is web 33, with material required to provide the needed strength of the extrusion placed in tubular elements 30, 31.

The overall construction of the cross-section in preferred form is as follows: The cross-section is asymetrical along the transverse axis 40, defined as the axis passing through both tubular elements and bisecting the web 33 at its center. The cross-section is symmetrical about neutral axis 41, defined as the axis normal to the transverse axis, normal to the outer face of web 33, and passing through the web at its midpoint. The maximum dimension along axis 40 is 0.800 in. and the maximum along axis 41 is 0.400 in. at each tubular element, while the minimum web thickness is 0.040 in. at the neutral axis. The radius of wall 36 is taken from the intersection of the transverse and neutral axes, with the outer radius being 0.400 in. and the inner radius being 0.355 in., resulting in wall thickness of 0.045 in. for wall 36. Channel 34 is defined by a radius of 0.276 in. taken from a point on the neutral axis, and the interior surface of tube wall 37 is also defined by a radius of 0.311 in. taken from the same point, resulting in a thickness of 0.035 in. for wall 37. Wall 38 is straight for the majority of its length and forms an angle of thirty degrees with the neutral axis or sixty degrees with the transverse axis. The outer face of web 33 has a length of 0.312 in. as measured along this face between the projected intersections of the straight outer surfaces of walls 38 and 38'.

The unions between walls 36, 37, and 38 and web 33 are preferably contoured with curves both on the surface and interior of the tubular element 30. Wall 36 meets both walls 37 and 38 with an interior curve 44 of 0.033 in. radius and an exterior curve 45 of 0.072 in. radius. The interior junction of walls 37 and 38 has a curve 46 of 0.025 in. radius, and wall 38 meets web 33 at surface curve 47 having 0.050 in. radius and interior curve 48 of 0.085 in. radius.

Another preferred extrusion cross-section that is suitable for the racket 10, but that has slightly less resistance to local shear from string tension, is formed by making the cross-section of FIG. 12 symmetrical about the transverse axis, the inner channel side of FIG. 12 being replaced by a mirror image of the outer channel side. In creating this new cross-section, curve 48 becomes unnecessary and curve 46 at the interior union of walls 37 and 38 with web 33 preferably has a radius of 0.050 in.

In either of the described embodiments, the cross-section remains symmetrical about the neutral axis, and corresponding parts of the structure associated with tubular element 31 are similarly numbered to those associated with element 30. Preferred materials for any of these extrusions include 6061-T6, 7005-T53, or 7046-T53 aluminum.

The appropriate metal extrusion is cut to size and formed into the desired shape of the racket frame as shown in FIGS. 1 and 11. The center of the extrusion becomes the top of the racket frame as viewed in these figures, and the extrusion is bent symmetrically to form a string face and handle with the free ends of the extrusion being near the bottom of the handle. Frame portion 22 only partially defines the string face as it curves in the general shape of an oval, ellipse, circle, or other desired pattern, leaving an open throat as the frame reverse curves near the bottom of the string face and opposite lengths of the frame become increasingly parallel as they approach the bottom of the racket, as viewed in FIGS. 1 and 11. At some point in the handle portion 23, the opposite lengths of the frame become parallel to each other and to the longitudinal axis of the racket, and then angle slightly away from each other and the longitudinal axis, for example at an included angle between one-half degree and three degrees.

In one embodiment wherein the racket is approximately twenty seven inches in length, halves of the frame extrusion may become parallel about ten and one-half inches from the bottom of the handle and the parallel portions 49 remain so for approximately four inches, or until approximately six and one-half inches from the bottom of the handle, where divergent portions 50 begin. Parallel portions 49 may have a spacing of about 0.657 inches between the centers of the opposite members. At the interface between portions 49 and 50 the free ends of the racket are angled outwardly at bend 51 at an angle of approximately 0.8197 degrees away from the longitudinal axis of the racket in the plane of the racket.

Figure 2:
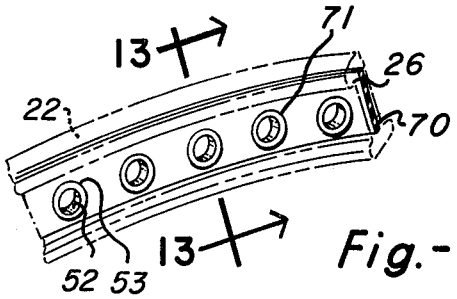
FIG. 2 is an enlarged perspective view of a broken-out portion of the grommet strip, with the racket frame shown in phantom.

Either before or after forming the metal frame into the desired shape, stringing holes 52, FIGS. 2 and 13 may be punched or drilled into the web around the face portion 22. The web may be drawn inwardly toward the string face to produce a flanged ring 53 around each hole, and on the outer surface of the web the annular shoulder 54 surrounding the hole may be rounded. Both the flange and rounded shoulder increase the bearing surface against which the string will rest and aid in preventing string failure.

Figure 6:
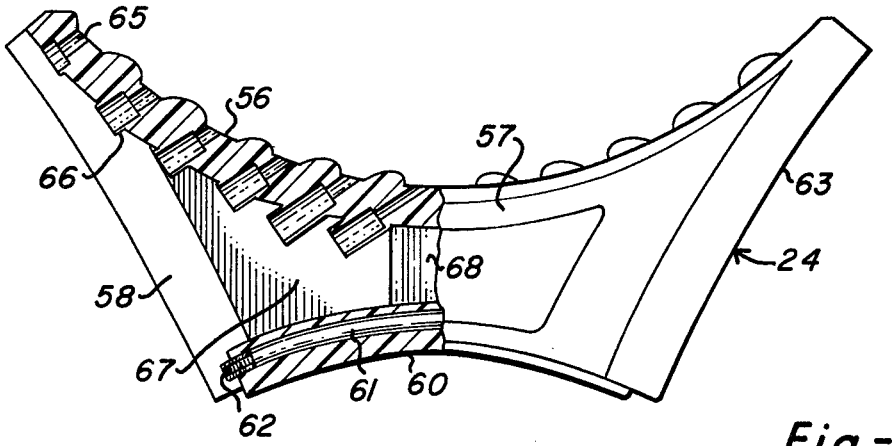
FIG. 6 is an elevational view of the yoke in partial section.

Yoke 24, best shown in FIG. 6, is placed in the open throat of the metal frame to complete the closed oval or like shaped string face. The yoke may have a torque-box configuration in order to provide rigidity at the throat of the frame 21 complimentary to the strength and rigidity of the extrusion. For this purpose, the top wall 56 is an arch concave to the string face and curved to conform to the intended outline of the string face. Front and rear walls 57 and 58, respectively, join arch 56 to lower wall 60, which is convex to the string face. The preferred material of construction for yoke 24 is an elastomer such as polyurethane, although more rigid compositions are also suitable, especially in applications wherein high stringing tensions are expected to be encountered. Lower wall 60 preferably contains an integral metal bridge 61 having a threaded screw hole 62 at each end thereof for the purpose of strictly limiting the deflection of the yoke along the longitudinal axis of the racket. This metal bridge fastens the yoke in place when it receives a screw through the web 33 of the metal frame. Thereafter, the bridge functions as a pivot for the yoke and aids in resetting the position of the yoke after heavy impact against the racket strings. The top wall 56 is also fastened directly to the frame by a screw or like fastener through web 33 and into an adjacent portion of the top wall.

As best shown in FIGS. 6 and 14, front and rear yoke walls 57 and 58 terminate at right and left hand sides with a lip 63, complimentary to the surface of the metal frame at walls 36. A pair of the lips 63 at either side of the yoke snugly snaps over the front and rear of the frame to hold the yoke in place in the plane of the racket. Vibration in the metal frame induced by ball contact against the racket strings is known to generate from the racket face and build in amplitude as it travels through the handle portion of the racket. The clamping action of yoke lips 63 on each side of the metal frame is intended to dampen the vibration at the yoke, resulting in the vibration having to re-generate from below the yoke with the result that vibration reaching the handle grip is of reduced magnitude.

Top wall 56 contains appropriate string holes 65, each having a sleeve 66 of relatively broad diameter as compared to the string hole, extending into the hollow core 67 of the yoke and angling toward the nearest side of the metal racket frame. The purpose of these sleeves is to aid in stringing the racket as will be more fully explained below.

Several modifications in the form of the yoke can alter the playing characteristics of the racket. Increased damping is obtained by filling the hollow core 67 with a foam such as polyurethane or a plastic material. The rigidity of the yoke is increased by adding a central wall 68 that divides the yoke into right and left hand halves, as viewed in FIG. 6.

With the yoke 24 in place, the outline of the racket face is complete, but grommet strip 26 may be added to provide cushioning between the strings and the metal racket frame. Grommet strips are well known for use with tennis rackets and generally include a strip of flat backing material 70, FIG. 2, having a plurality of eyelet tubes 71 extending normally from the backing sheet. Each eyelet tube is spaced on the backing strip to pass through one of the stringing holes 52 in the web of the metal frame. The backing strip may be of an appropriate width to fit inside the outer channel of the frame, and each eyelet tube extends through the stringing hole and past the inner extreme of the annular flange 53 to protect the string from contact with the metal. The outer shoulder 72, FIG. 13, at the junction of the backing strip and eyelet tube is preferably rounded to further increase the bearing surface against which the string rests and decrease localized bending.

Figure 3:
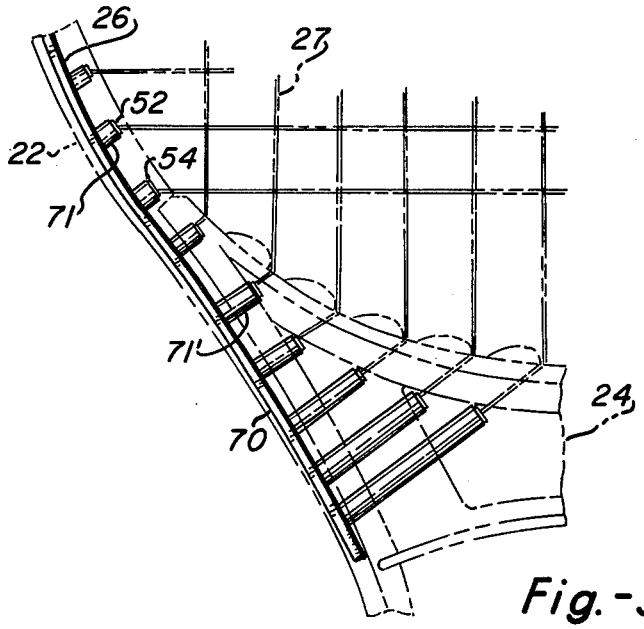
FIG. 3 is an elevational view of the grommet strip as it fits in the yoke of the racket, with the racket frame, yoke, and strings shown in phantom.

As best shown in FIG. 3, eyelet tubes 71' are necessary to direct the strings through the metal frame in the throat of the racket. These tubes have been progressively lengthened to accommodate the increased distance between the respectively lower string holes in the frame in the throat area and the actual string holes in the top wall of the yoke. Each of these eyelet tubes 71' extends into socketed engagement by a corresponding one of the sleeves 66, creating a complete passage through the hollow core 67 of the yoke.

Figure 4:
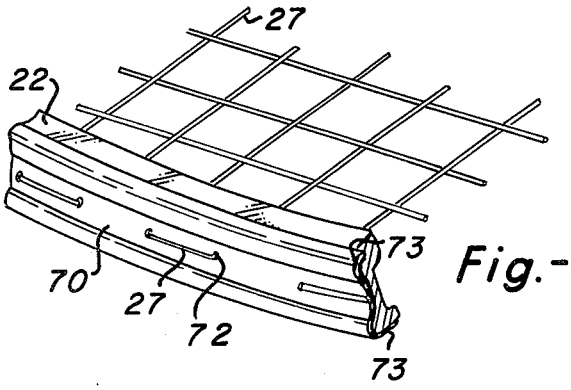
FIG. 4 is a perspective view of a broken-out section of a modified form of the grommet strip, shown from the outside of the racket frame.

In the embodiment shown in FIG. 4, a special grommet strip includes shielding means for protecting the metal frame from contact damage. This feature is especially useful for racket ball rackets, where the top of the racket frame may strike the walls of a game room. The backing strip is extended with a portion 73 having complimentary contour to the surface of tubular elements 30, 31, thereby providing a covering for the entire surface of the metal racket frame. The portion 73 may cover only the top end of the racket, but may be used over any greater portion of the frame as desired. The grommet strip is held in place by the racket stringing. In any embodiment of the grommet strip, the preferred material is an elastomer such as polyurethane to provide damping for the strings and correspondingly to increase the dwell time of the ball on the racket face.

The racket handle grip 25 is attached to the handle portion 23 of the metal frame to complete the racket structure. The frame structure that has been disclosed is less flexible longitudinally than known prior art rackets, primarily because of the illustrated frame cross-section. This rigidity of the frame is an advantage when the racket is constructed with proper damping characteristics, to prevent overly great vibration from being transmitted to the player. Accordingly, the handle grip 25 has high damping characteristics.

Figure 5:
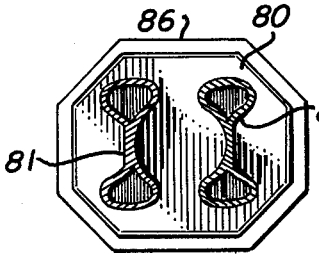
FIG. 5 is an enlarged cross-sectional view of the racket taken across the plane of line 5—5 of FIG. 1.
Figure 7:
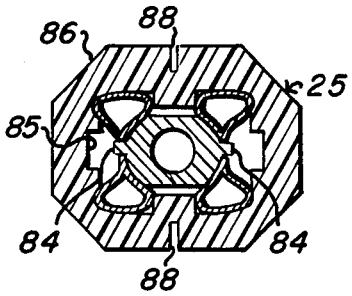
FIG. 7 is an enlarged cross-sectional view of the racket taken along the plane of line 7—7 of FIG. 1, showing details of the handle grip structure.

One handle structure best shown in FIGS. 5, 7 and 10 employs a molded elastomer or plastic shell 75 and wedge shaped plug 76. The shell is formed with a cellular skin construction best seen in FIG. 8. The hollow cells reduce the weight of the handle shell, while the cell walls 77 provide required strength, size, shape, and vibration damping between the metal frame and the player's hand. The upper or forward end of the shell 75 is slightly heavier in composition to form an integral front cap 80 having the strength to hold the spaced members of the metal frame in fixed position and this portion of the shell preferably has openings 81, 82 conforming exactly to the exterior contour of the extrusion cross-section for admitting the lengths of handle portion 23 while sealing snugly against the surface thereof. The interior of the shell conforms closely to the contour of the tubular elements of the extrusion, particularly at the surface of walls 36, and the outside curves 45, as these portions of the frame define the four corners of a rectangle that is the structural base of the handle grip.

Plug 76 has an exterior shape conforming to the arch of inner channel 34 and also has a longitudinal taper conforming to the deflection of the frame halves at portion 50 from the longitudinal axis, as has been previously described. When the plug is inserted through the open lower end of the shell, the handle is locked in place due to the taper of the plug. If desired for added integrity of structure, the plug may have lateral projecting bosses 84 that are engaged in apertures 85 near the free ends of the extrusion, locking the plug permanently into position between the ends of the extrusion. The shell 75 flares in thickness at the lower end of the racket to form an integral rear cap 86. A cover plate 87 may be applied over the open end of the shell to completely close the shell, or the cover plate may be an integral part of wedge 76. The plug may be formed from solid or foamed elastomer, plastic, wood, or other suitable material. If desired, the wedge plug may be injection molded into the shell after the shell is in place on the metal frame. The flared base 86 of the shell may be formed with integral slots or recesses 88 to receive the starting end of the handle wrap 89. FIG. 1, which traditionally is leather.

Figure 8:
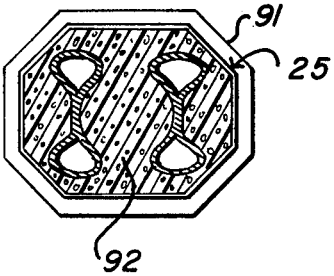
FIG. 8 is an enlarged cross-sectional view of a modified form of the handle grip, taken along the plane of line 8—8 of FIG. 1.
Figure 9:
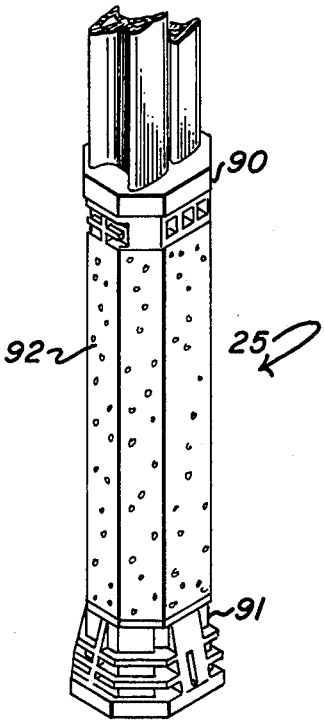
FIG. 9 is a perspective view of the handle grip of FIG. 8.

Another embodiment of the handle, best shown in FIG. 8 and 9, employs a pair of independent caps, including front cap 90 that fits the metal frame much like portion 80 of the above described shell, and a rear cap 91 similar in form to the described shell portion 86. These two caps are placed over the handle portions 50 of the metal frame in essentially the same positions as corresponding cap portions 80 and 86 of the shell for the purpose of holding the two ends of the frame in proper spaced relationship. The area intermediate the caps may then be filled with a foamed elastomer, plastic or like weight material 92. Such foamed material may lack the strength to serve as a handle grip in the absence of the caps 90, 91, but is adequate as a filler and support in the handle when the caps are in place. Another variation may employ caps 90 and 91 as described, with plug 76 inserted between the opposite lengths of the metal frame to provide strength and positive outward force holding the frame ends in proper position to be locked into the handle grip. The remaining outer area of the handle may be filled with foamed material 92.

With any of the described handle embodiments, the racket frame and the handle grip are firmly united. The slight divergence between frame portions 50 holds the handle grip in firm contact with the frame, allowing the damping materials of the grip to absorb the vibration of ball contact with the racket.

I claim:

1. An improved racket for tennis and like games, of the kind having a metal frame defining a racket plane with a face portion and a handle portion of the racket, the frame being symmetrical on opposite sides of a longitudinal racket axis, the frame being formed from an elongated continuous strip of metal having its central portion outlining a racket face at the forward end of the longitudinal axis, the face having an open throat, and end portions of the strip defining a racket handle extending generally rearwardly along the longitudinal racket axis from the open throat and terminating at the opposite free ends of the elongated strip; the racket having a yoke closing the open throat of the frame; and a handle grip engaging the free ends of the frame; wherein the improvement comprises:

(a) said metal frame having a cross-sectional configuration taken normally to the plane of the racket with a first hollow tubular element facing the first side of the racket plane, a second hollow tubular element facing the second side of the racket plane, and an intermediate web joining the first and second tubular elements, a transverse axis passing normally through the racket plane through the web and both tubular elements, and a neutral axis of symmetry in the racket plane bisecting the cross-sectional configuration and intersecting said transverse axis, wherein said first and second tubular elements have outer wall portions respectively facing said first and second sides of the racket plane, each of said outer wall portions configured on a radius from the intersection of said transverse and neutral axes;

(b) the maximum width of the cross-section along the neutral axis being approximately one-half the maximum dimension of the cross-section along the transverse axis;

(c) the length of said web along the transverse axis being between 35% and 45% of the maximum dimension of the cross-section along the transverse axis; and (d) the minimum thickness of the web along the neutral axis being approximately 10% of the maximum dimension of the cross-section along the neutral axis and the cross-sectional surface area of the web being between ten and twenty percent of the total cross-sectional surface area of the metal frame.

2. The racket of claim 1, wherein said yoke comprises:

(a) a first bridge in the plane of the racket concave to the face portion of the racket frame and connected to the frame at each of its ends to close said open throat, and a second bridge in the plane of the racket convex to the face portion of the frame, joined to the racket frame at each of its ends and spaced rearwardly from said first bridge;

(b) a pair of spaced walls joining said first and second bridges, each of the walls being on an opposite face of the racket plane, the pair of walls and the first and second bridges forming a torque-box structure for resisting torsional deformation of the racket frame;

(c) each of said spaced walls having a lip at the lateral sides thereof extending over a portion of the frame adjacent to the yoke, the lips at corresponding sides of the opposite walls cooperatively engaging the frame and clamping the yoke thereto, the lips damping vibration generated on the racket face as it travels to the racket handle.

3. The racket of claim 2, wherein said yoke is constructed from synthetic materials selected from the class consisting of plastics and elastomers, and the second bridge further comprises a metal arch approximately following the curvature of the second bridge and having fastening means connecting the opposite ends of the arch to said metal frame for limiting the deflection of the synthetic portion of the yoke along the longitudinal racket axis.

4. The racket of claim 1, wherein the racket handle comprises spaced, mutually convergent portions of said elongated metal strip running rearwardly from said open throat to an intermediate area of the handle, and spaced mutually divergent portions of said metal strip running rearwardly from the intermediate area toward the free ends of the metal strip, wherein both the outward and inward facing side of each divergent strip portion are divergent from the corresponding side of the opposite divergent strip portion of the racket handle.

5. The racket of claim 4, wherein said divergent portions of the metal strip are angled rearwardly and laterally away from the longitudinal racket axis in the plane of the racket at an angle of less than one degree.

6. The racket of claim 4, wherein said handle grip comprises:

(a) an elastomeric sleeve overlapping said divergent portions of the metal strip and contacting the outer wall portions of said first and second tubular elements; and (b) a wedge shaped plug between the mutually facing surfaces of the divergent portions of the metal frame strip and having a longitudinal contour conforming to the divergence of said divergent portions, the plug contacting the mutually facing surfaces to maintain a spaced relationship therebetween.

7. The racket of claim 6, wherein said web defines an aperture located near a free end of the metal strip, and said plug further comprises a boss on the lateral surface thereof engageable with the aperture to lock the plug in fixed position between said divergent portions of the metal strip.

8. The racket of claim 4, wherein said grip further comprises:

(a) independent forward and rearward caps, said forward cap having apertures therein configured to longitudinally receive said divergent portions of the metal frame strip and located near the junction of the intermediate area and the divergent portions of the handle; and the rearward cap engaging the free ends of the frame strip and being spaced longitudinally rearwardly from the forward cap, the two caps together defining an intermediate space having portions of the metal frame strip passing longitudinally therethrough; and (b) foamed plastic filler means occupying said intermediate space and surrounding said metal frame strip portions therein to define the shape of the handle grip.

9. The racket of claim 4, wherein said grip further comprises:

(a) independent forward and rearward caps, said forward cap having apertures therein configured to longitudinally receive said divergent portions of the metal frame strip and located near the junction of the intermediate area and the divergent portions of the handle; and the rearward cap engaging the free ends of the frame strip and being spaced longitudinally rearwardly from the forward cap, the two caps together defining an intermediate space having portions of the metal frame strip passing longitudinally therethrough;

(b) a wedge shaped plug located between said divergent portions of the metal frame strip and having a longitudinal contour conforming to the divergence of said divergent portions, the plug contacting the mutually facing surfaces to maintain a spaced relationship therebetween; and (c) foamed plastic filler means surrounding the exterior surface of the handle in the intermediate space.

10. The racket of claim 4, wherein said divergent portions of the metal strip diverge rearwardly at an included angle of between one-half and three degrees.

11. The racket of claim 1, wherein the length of said web along the transverse axis is between 37 and 41 percent of the maximum dimension of the cross-section along the transverse axis.

12. The racket of claim 1, wherein the cross-sectional configuration of the metal frame further comprises an outer channel on the side of the web generally facing the exterior of the racket frame in the racket plane, and an inner channel on the side of the web generally facing the interior of the racket frame in the plane of the racket, each channel being defined by a surface of the web and portions of each of said tubular elements, wherein said inner channel comprises an arc having a radius taken from a point on the neutral axis.

13. The racket of claim 12, wherein said radius of the arc is between 87% and 90% of the length of the web.

14. An improved yoke for a tennis racket of the kind having a metal frame partially defining a face portion of the racket and defining a handle portion, the frame forming an open throat at the junction of the face and handle portions, the handle portion terminating oppositely from the face portion with spaced free ends of the metal frame engaged in a handle grip, and the throat having the yoke therein to close the face portion of the racket, wherein the improved yoke comprises:

(a) a first bridge concave to the racket face and connected at each of its ends to said metal frame to complete the face portion of the racket;

(b) a second bridge convex to the face portion of the racket and spaced from said first bridge relatively closer to said handle grip;

(c) a pair of spaced apart walls lying in substantially parallel planes and substantially parallel to the racket plane, each joining said first and second bridges at the opposite faces of the racket plane, respectively, to define a torque box structure that resists torsional deformation of the yoke; and (d) a lip at the lateral edges of each of said walls overlapping the metal frame, corresponding lips on opposite walls cooperating to clamp the yoke to the metal frame;

(e) each of said lips being formed from a resilient material for damping vibrations traveling from the face portion to the handle portion of the metal frame.

15. The yoke of claim 14, wherein said first bridge, pair of spaced walls, and portions of said second bridge are formed from said resilient material for damping vibration in the metal frame; wherein the second bridge further comprises a metal arch integral with the second bridge and having its opposite ends pivotally connected to the metal frame for resisting displacement of the yoke.

16. A handle grip for use with a game racket of the type having a face portion at the forward end thereof and a handle portion extending rearwardly from the face portion and comprising a pair of spaced apart frame members terminating in free ends at the rear of the frame, the frame members having rearwardly divergent segments in the plane of the racket near the free ends thereof, the handle grip comprising:

(a) a tubular sleeve having a forward opening for receiving said pair of spaced apart frame members into the sleeve, and a rearward opening;

(b) a wedge shaped plug adapted to be received in the sleeve through said rearward opening and between the interior areas of the sleeve to be occupied by the spaced apart frame members, the plug having a forward taper for maintaining the divergence of the frame segments when engaged against them in the sleeve.

17. The handle grip of claim 16, wherein the forward taper of said plug has an included angle between one-half and three degrees.

* * * * *